US008191302B1

(12) United States Patent
Swan

(10) Patent No.: US 8,191,302 B1
(45) Date of Patent: Jun. 5, 2012

(54) FOLDING FRONT SIGHT WITH LASER AIMING DEVICE

(76) Inventor: Richard E. Swan, E. Bridgewater, MA (US)

( * ) Notice: Subject to any disclaimer, the term of this patent is extended or adjusted under 35 U.S.C. 154(b) by 149 days.

(21) Appl. No.: 12/786,426

(22) Filed: May 24, 2010

Related U.S. Application Data

(63) Continuation-in-part of application No. 12/361,593, filed on Jan. 29, 2009, now Pat. No. 7,721,482.

(60) Provisional application No. 61/025,365, filed on Feb. 1, 2008.

(51) Int. Cl.
*F41G 1/36* (2006.01)

(52) U.S. Cl. ..... 42/114; 362/110; 42/117; 42/148

(58) Field of Classification Search ..... 42/114, 42/115, 117, 142, 146, 140, 148; 89/110, 89/111, 113, 114; 362/110, 111, 113, 114
See application file for complete search history.

(56) References Cited

U.S. PATENT DOCUMENTS

| | | | | |
|---|---|---|---|---|
| 621,066 | A | 3/1899 | Gilbert-Russell | |
| 861,652 | A | 7/1907 | Hawkins | |
| 878,857 | A | 2/1908 | Bevier | |
| 2,331,903 | A * | 10/1943 | Garand | 42/140 |
| 4,677,782 | A * | 7/1987 | Kaye et al. | 42/132 |
| 4,766,800 | A | 8/1988 | Miller et al. | |
| 5,533,292 | A | 7/1996 | Swan | |
| 6,732,467 | B1 | 5/2004 | Luth | |
| D526,380 | S | 8/2006 | Swan | |
| 7,121,432 | B2 * | 10/2006 | Kostal et al. | 222/192 |
| 7,181,882 | B2 | 2/2007 | Woodbury | |
| 7,356,962 | B2 | 4/2008 | Swan | |
| 7,721,482 | B1 | 5/2010 | Swan | |
| 2007/0006513 | A1 | 1/2007 | Snyder et al. | |

FOREIGN PATENT DOCUMENTS

| | | |
|---|---|---|
| CH | 666544 | 7/1988 |
| WO | 2006138106 A2 | 12/2006 |

OTHER PUBLICATIONS

"A.R.M.S. Silhouette #41-B-Folding Front Sight Barrel Mounted", http://www.operationparts.com/A_R_M_S_SILHOUETTE_41_B_Folding_Front_sight_p141-b.htm.

* cited by examiner

*Primary Examiner* — Stephen M Johnson
(74) *Attorney, Agent, or Firm* — Barlow, Josephs & Holmes, Ltd.

(57) ABSTRACT

A folding front sight for a firearm includes a laser aiming device within the folding sight frame. The folding front sight includes a base, and a sight frame having a front sight post. The sight frame is movable between an upright deployed position, and a stowed position. A laser aiming module is mounted within the sight frame and is movable with the forward sight frame such that when the forward sight frame is in an upright deployed position, the laser aiming module is in a stowed position, and further such that when the forward sight frame is in a stowed position, the laser aiming module is in a deployed position. The device further includes a power source and a switch for selectively energizing said laser aiming module to output an aiming beam.

1 Claim, 22 Drawing Sheets

FOLDING FRONT SIGHT WITH LASER AIMING DEVICE

CROSS-REFERENCE TO RELATED APPLICATION

The present application is a continuation-in-part of U.S. patent application Ser. No. 12/361,593, filed Jan. 29, 2009, now U.S. Pat. No. 7,721,482 which is a non-provisional of and claims priority to U.S. Provisional Patent Application Ser. No. 61/025,365, filed Feb. 1, 2008. The entire contents of both prior applications are incorporated herein by reference.

BACKGROUND OF THE INVENTION

1. Field of the Invention

The present invention relates generally to firearms and more specifically to a collapsible front sight for rifles and carbines.

2. Background of the Related Art

Referring now to FIG. 1, for 40 years, the current standard front sight 10 attached to a barrel 12 of the AR-15, M4, and M-16 family of weapons includes a triangle-shaped profile, which is readily identifiable throughout the world. This well thought out and combat proven design includes a rear-angled support 14 for greater strength, which gives the front sight 10 its distinct triangle silhouette. The angled support feature also helps deflects branches, wires, and other combat hazards that could get a weapon hung up at the worst of times.

However, when enhanced optical sighting systems, such as scopes, are used, the infantryman does not need the front sight and often finds it to interfere with his aiming. Consequently, infantrymen use front sights that fold or collapse or they remove the front sight entirely from the weapon. However, using a prior art folding sight or removing the sight from the weapon necessarily changes the appearance of the weapon. In the case of special operations personnel, having a non-standard looking weapon can compromise the identity of the individual, which in turn can compromise operational security. Accordingly it would be desirable to have a folding front sight that more closely resembles a standard front sight in order to preserve the anonymity of the special operations personnel.

SUMMARY OF THE INVENTION

The folding front sight of the present invention solves the problems of the prior art by providing a front sight with a base with a forward end and a rearward end. A forward sight frame at the forward end of the base is included. The forward sight frame includes a front sight post at an upper end thereof, and is movable between an upright deployed position and a stowed position. A support member has a rear end extending from the rearward end of the base and a forward end engaged with the upper end of the forward sight frame to support the forward sight frame, when the forward sight frame is in the deployed position. The base, the forward sight frame and the support member cooperate to define a triangular silhouette when the forward sight frame is in the deployed position.

A further aspect of the invention include the provision of a laser aiming device within the forward sight frame of the folding sight to provide enhanced target acquisition during night time or low-light operations. The alternative folding front sight includes a base, and a sight frame having a front sight post. The sight frame is movable between an upright deployed position, and a stowed position as in the first embodiment. Additionally, a laser aiming module is mounted within the sight frame and is movable with the forward sight frame such that when the forward sight frame is in an upright deployed position, the laser aiming module is in a stowed position, and further such that when the forward sight frame is in a stowed position, the laser aiming module is in a deployed position and operational to emit an aiming beam parallel to the barrel of the weapon. The device further includes a power source and a switch for selectively energizing said laser aiming module to output an aiming beam. The laser module further includes windage and elevation adjustments for accurate targeting.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENTS

Figure 1:
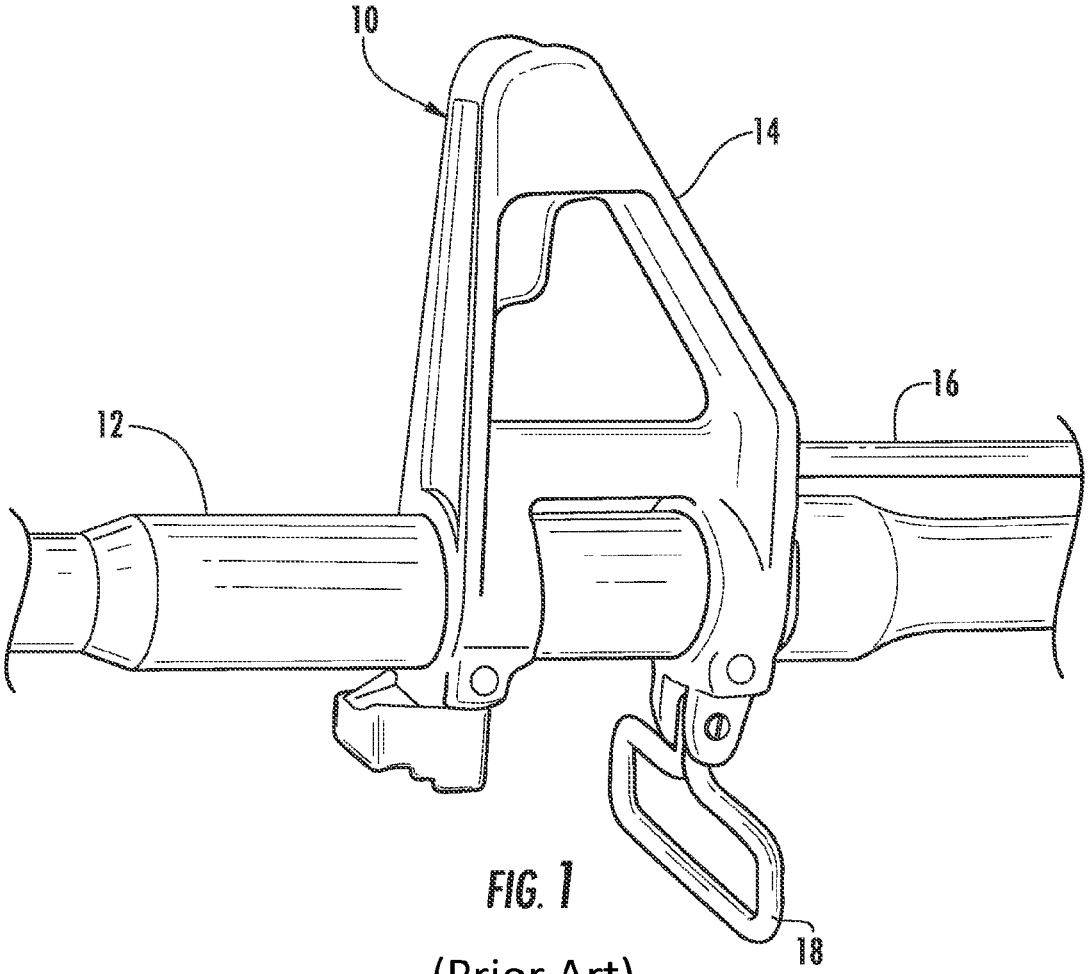
FIG. 1 (Prior Art)
FIG. 1 is a perspective view of a prior art non-folding front sight.
Figure 2A:
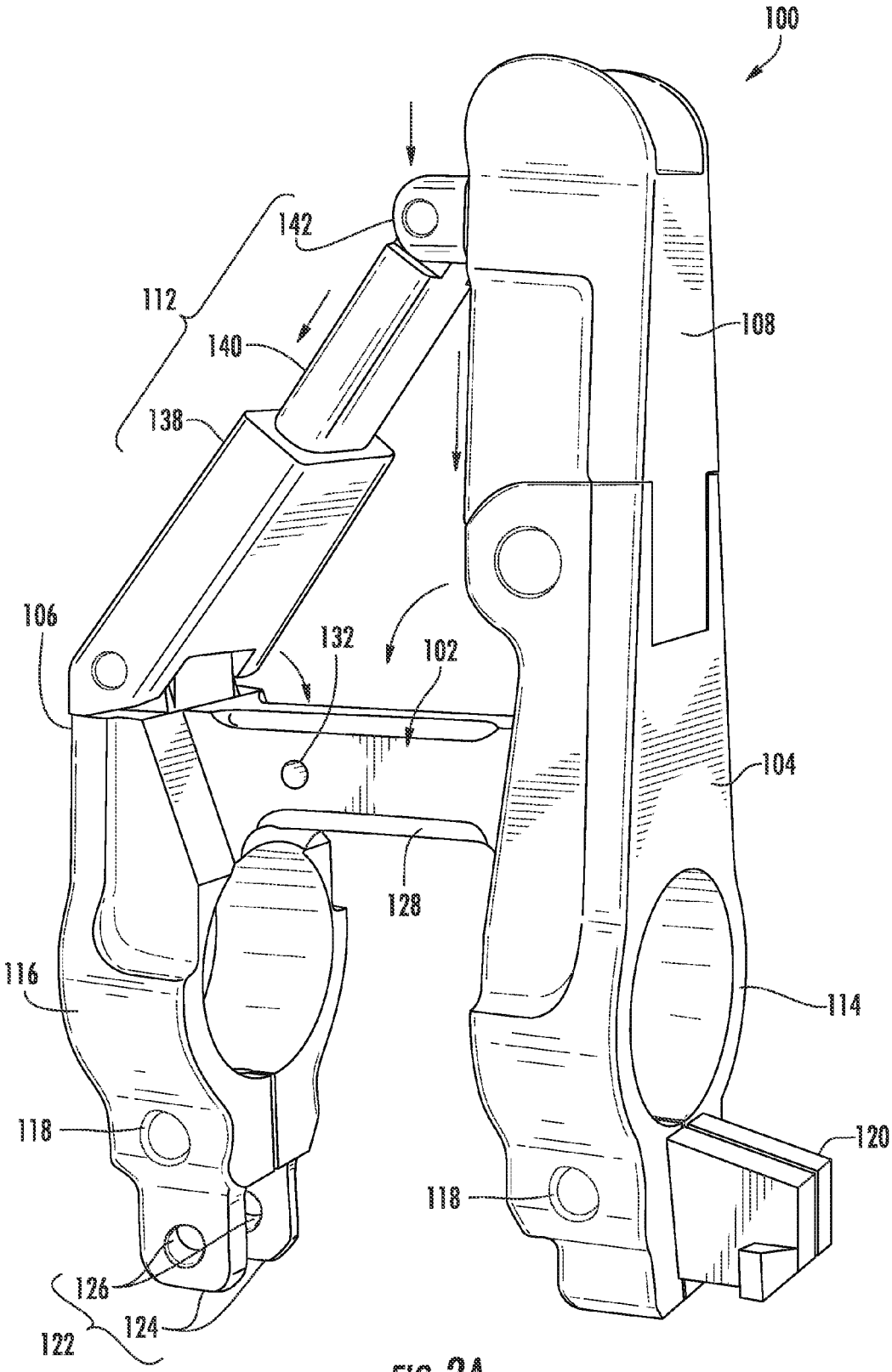
FIG. 2A is front perspective view of an embodiment of the folding front sight of the present invention.
Figure 2B:
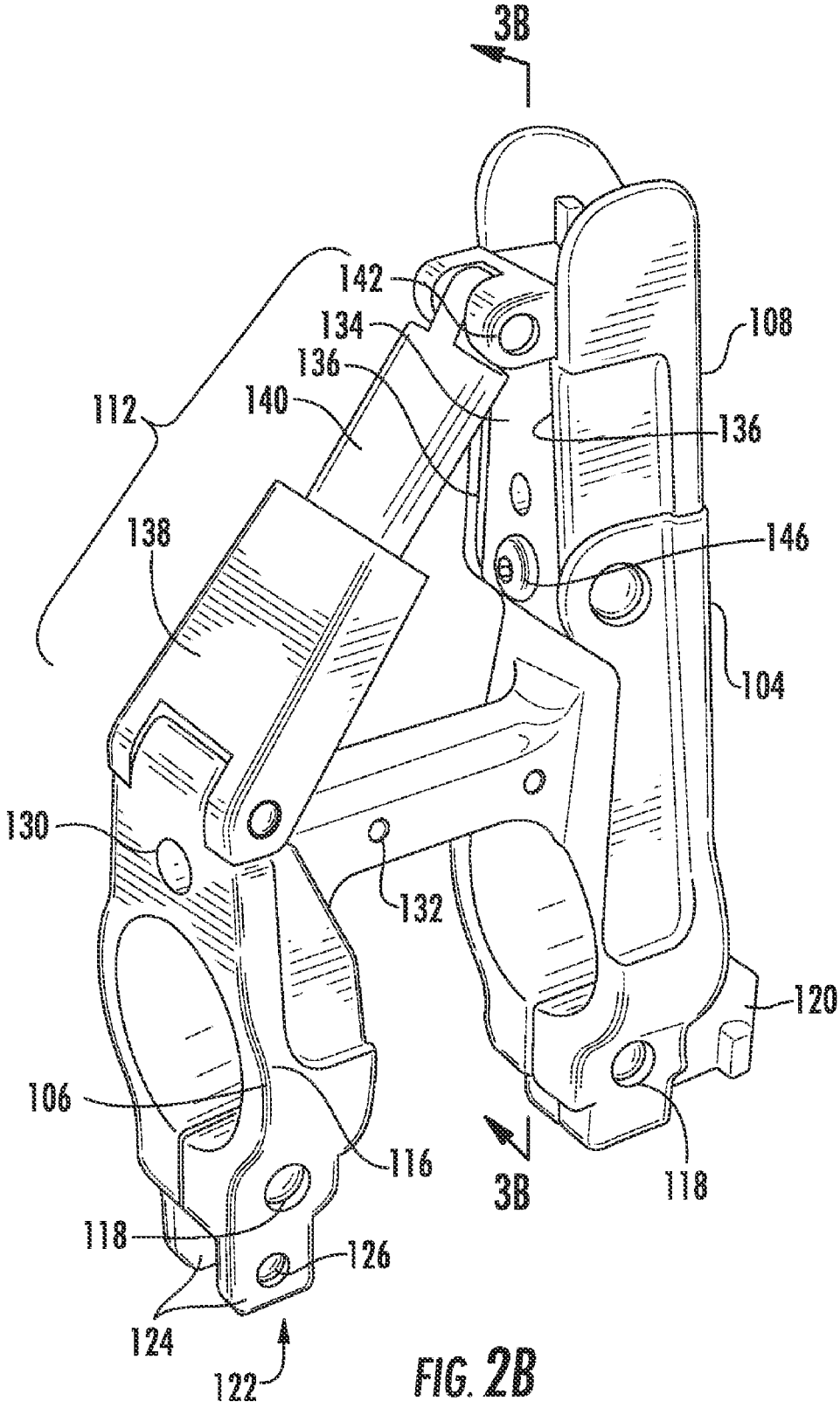
FIG. 2B is rear perspective view thereof.
Figure 3A:
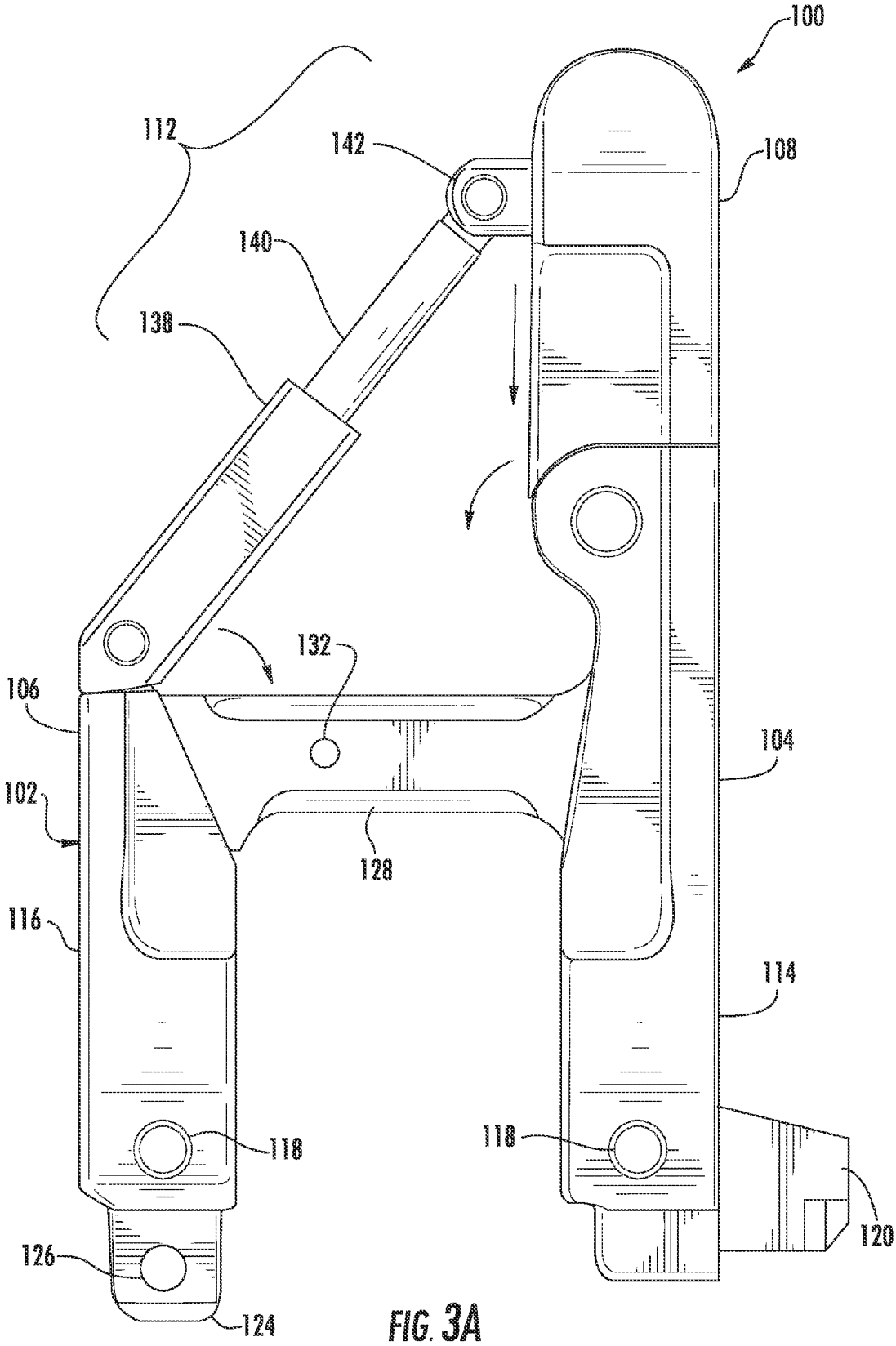
FIG. 3A is a right side view thereof.
Figure 3B:
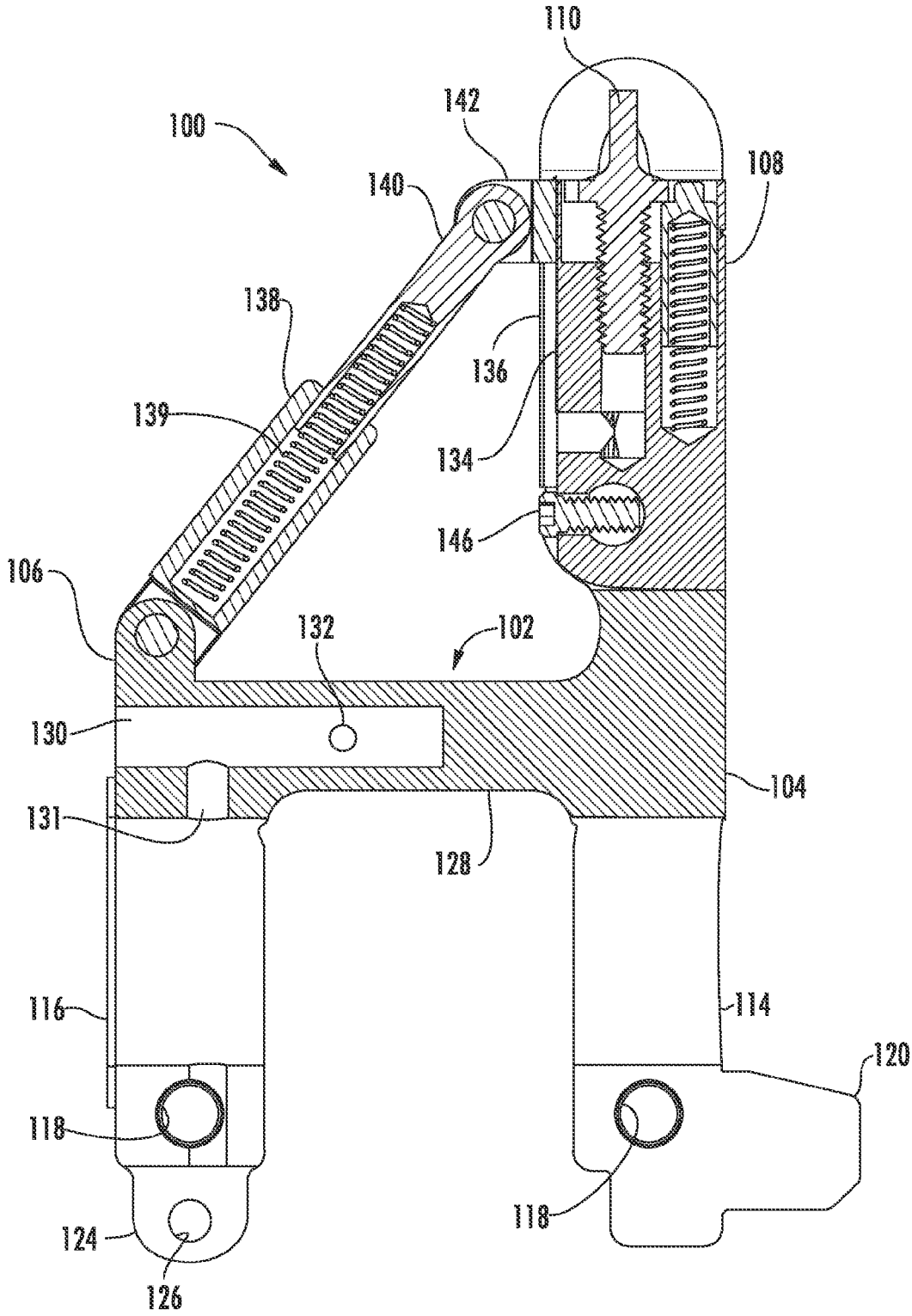
FIG. 3B is a side cross-section view through line 3B-3B of FIG. 2B.
Figure 4:
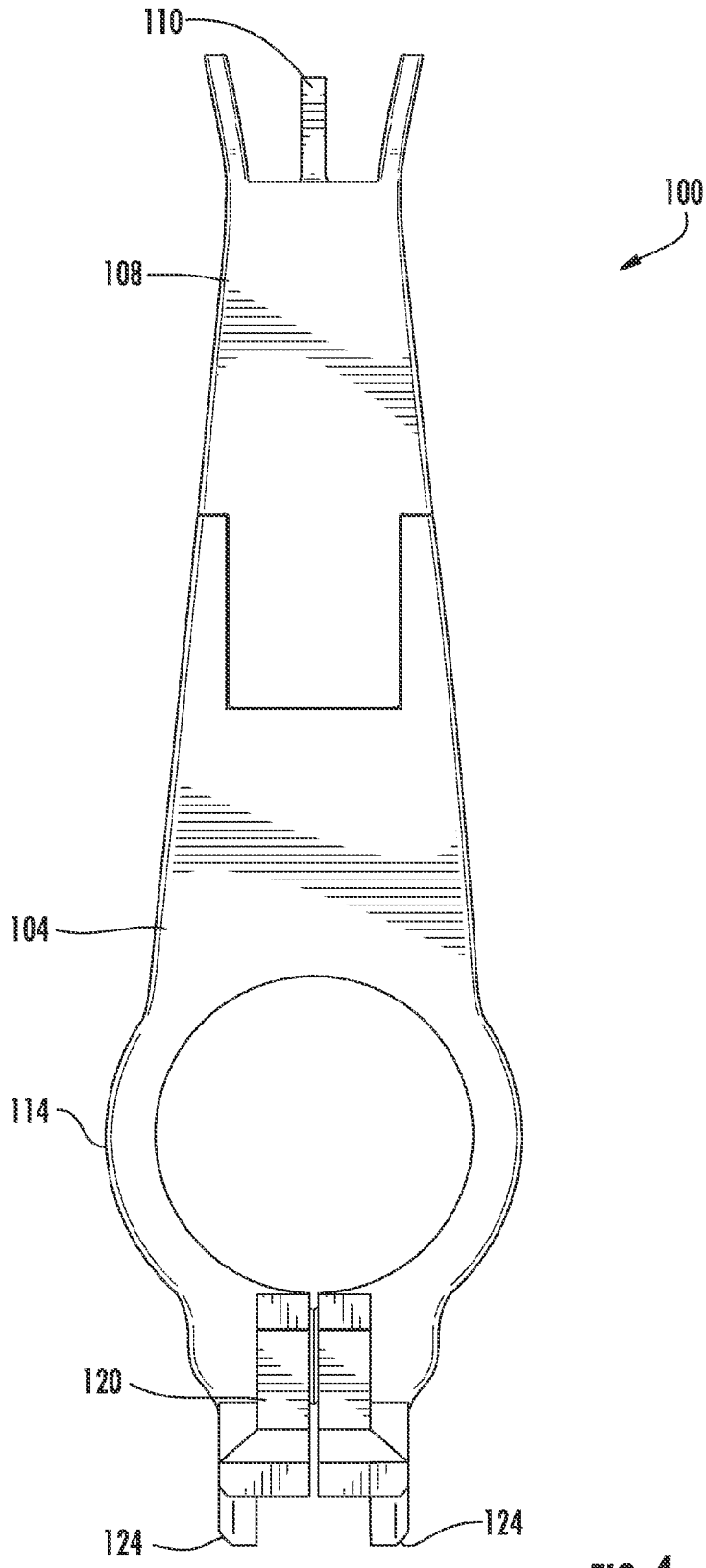
FIG. 4 is a front view thereof.
Figure 5:
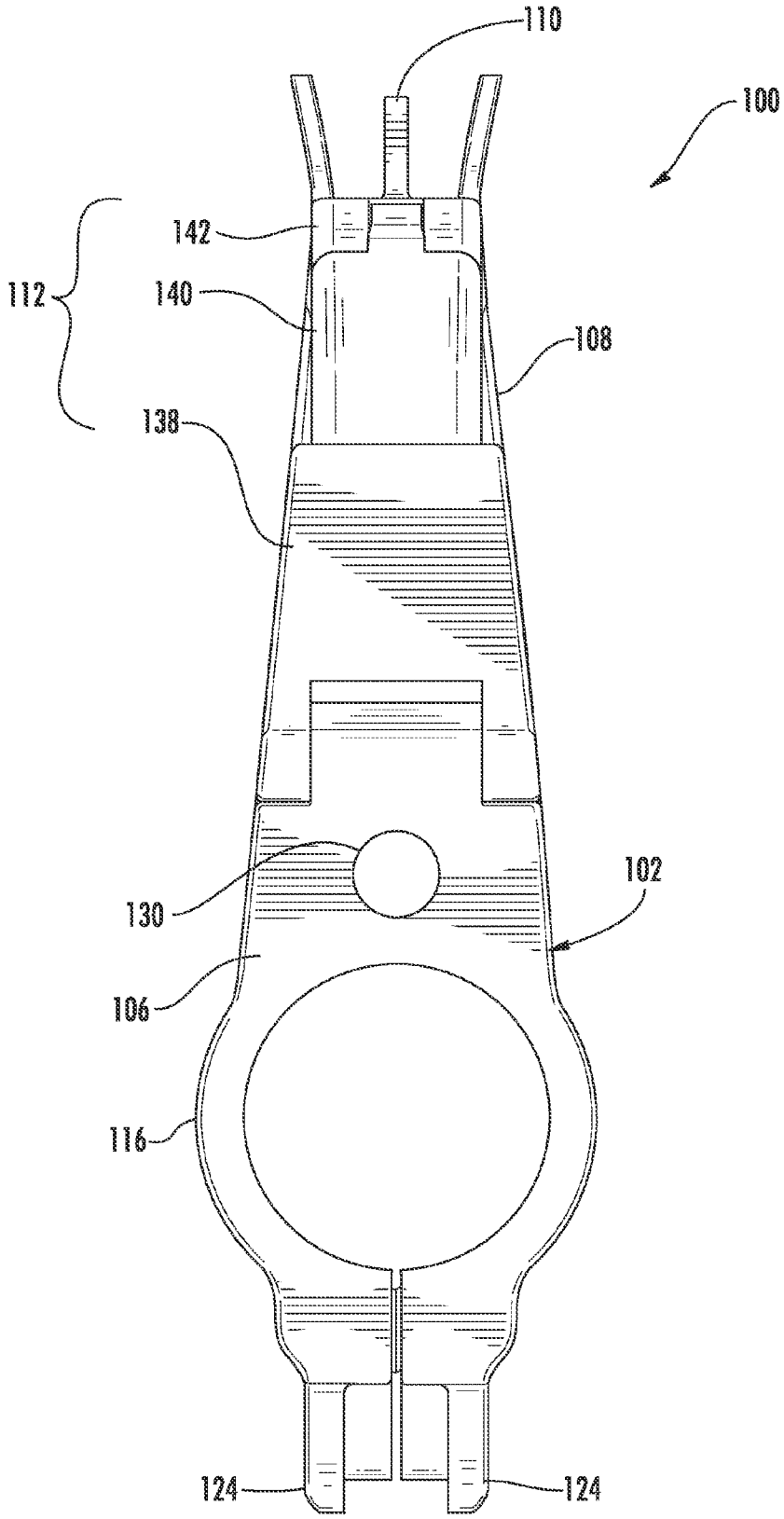
FIG. 5 is a rear view thereof.
Figure 6:
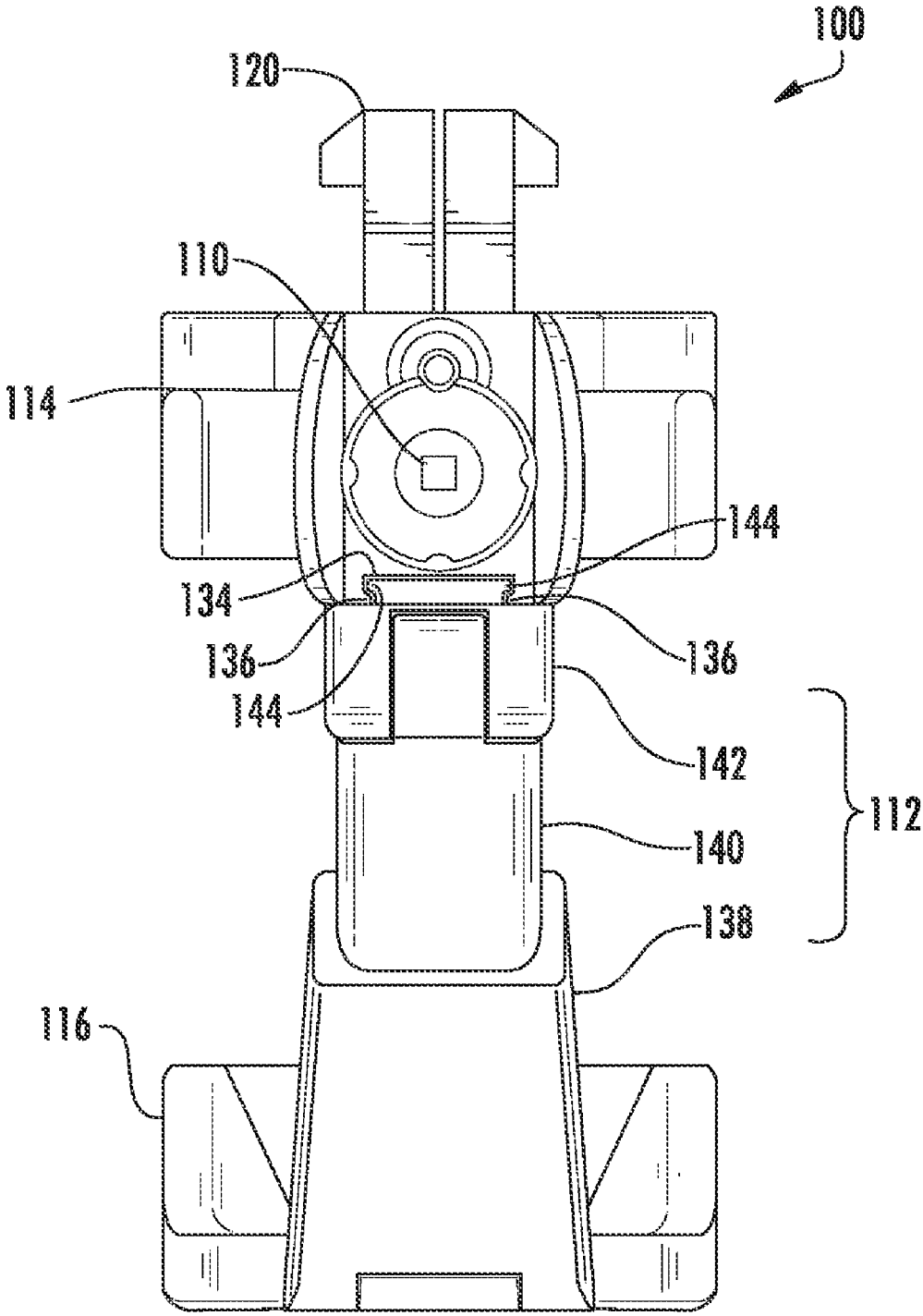
FIG. 6 is a top view thereof.
Figure 7:
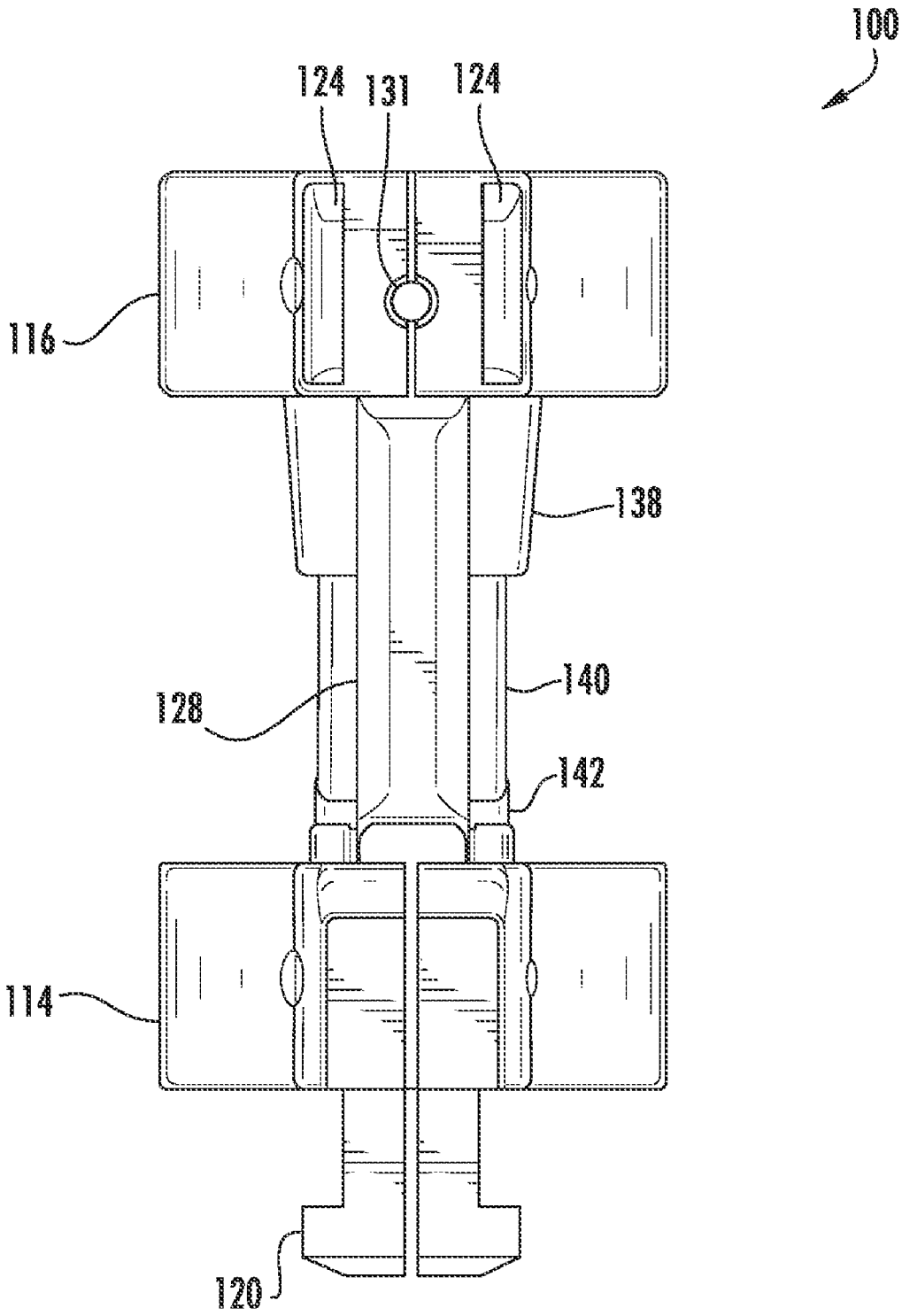
FIG. 7 is a bottom view thereof.

Referring now to FIGS. 2-8, the folding front sight of the present invention is shown generally at 100. The folding front sight 100 includes a base 102 having a front portion 104 and a rear portion 106; a forward sight frame 108 having a front sight post 110 is pivotally attached to the front portion 104 of the base 102. Extending from the rear portion 106 is an extendable slide arm assembly 112, which is connected to the rear portion 106 of the base 102 and the forward sight frame 108, which will be further described below.

Figure 8:
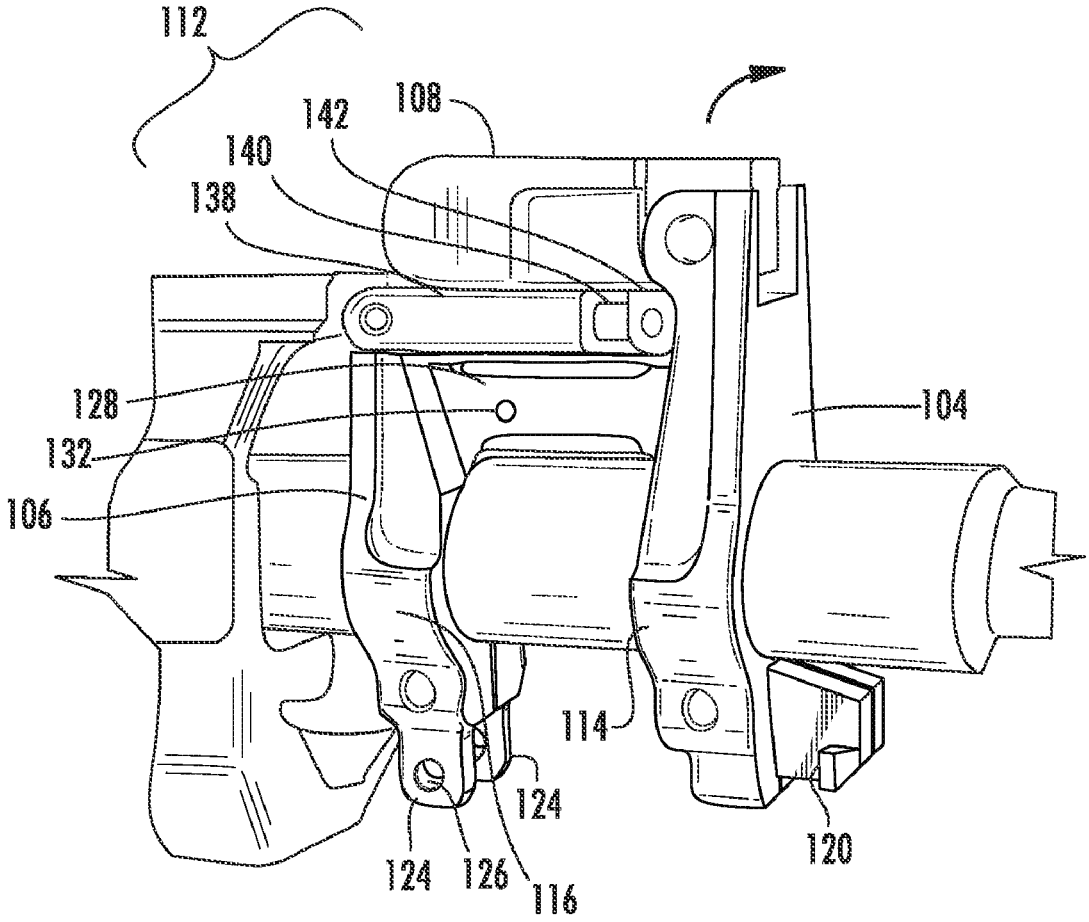
FIG. 8 is a perspective view showing the folding front side mounted to a barrel of a rifle and stowed in its folded state.

The front and rear portions 104, 106 of the base 102 include a pair of clamps 114, 116 configured to secure about a barrel of a weapon, such as an M-16 or AR-15 rifle or carbine as shown in FIG. 8. Threaded apertures 118 are provided near the bottom of the front and rear portions 104,106 to receive screws (not shown) used to tighten and retain the clamps 114, 116 on the barrel of the firearm.

Optionally, a bayonet lug 120 may be formed to the front face of the forward most clamp 114. The bayonet lug 120 configured to receive and retain a bayonet, such as a standard USGI M7 Bayonet, to the barrel of the weapon.

Optionally, a sling swivel mounting structure 122 may depend below the rearward most clamp. The sling swivel mounting structure 122 is configured for attaching a sling swivel and sling (not shown) thereto. Specifically, the sling swivel mounting structure 122 includes a pair of tabs 124. Each tab has a hole 126 formed therethrough. A sling swivel may be secured to the sling swivel mounting structure 122 by pinning it through the holes 126 on the tabs 124 as is known in the prior art.

Connecting the front and rear portions 104, 106 of the base 102 together is a center member 128. A gas tube fitting 130 is formed through the rear portion 106 of the base 102 and into the center member 128. The gas tube fitting 130 is configured to receive a gas tube (best seen in FIG. 1 at 16) for gas-operated automatic and semi-automatic weapons. The gas tube is retained in the gas tube fitting 130 by a pin (not shown) inserted through an aperture 132 formed on the center member 128 and into the gas tube fitting 130. Another aperture 131 is formed through the clamp 116 on the rear portion 106 and is in communication with the gas tube fitting 130. When placed on a firearm, the aperture on the clamp 116 is aligned with an aperture on the barrel in order to make the gas-operation reloading of the firearm function.

Extending upwardly from the front portion 104 of the base 102 is the forward sight frame 108. The forward sight frame 108 includes a sight with a height adjustable front sight post 110. The forward sight frame 108 is pivotally connected to the front portion 104 of the base 102 and configured to fold rearward towards the rear portion 106 of the base 102. The forward sight frame 108 includes a back surface having slot 134 with a pair of raised lips 136 that forms a track, best seen in FIGS. 2A and 6.

The slide arm assembly 112 includes a slide arm base 138, a spring 139 (best seen in FIG. 3B) received into the slide arm base 138, a slide arm 140 slidably received into the slide arm base 138 and engaging the spring, and a knuckle 142 pivotally attached to the slide arm 140. The knuckle 142 slidably engages the track on the forward sight frame 108 and a pair of opposing feet 144 engages each of the recesses formed by the raised lips 136 on the track, respectively. A set screw 146 prevents the knuckle 142 from coming free from the track. The bottom surface of the knuckle 142 includes a recess to receive a head of the set screw 146. One end of a slide arm 140 is pivotally connected to the knuckle 142 and the other end of the slide arm 140 is received in one end of a slide arm base 138. The spring 139 biases the slide arm 140 outwardly from the slide arm base 138. The other end of the slide arm base 138 is pivotally connected to the rear portion 106 of the base 102. As can best be seen in FIG. 3A, the silhouette of the slide arm assembly 112, center member 128 and forward sight frame 108 form a unique triangle shape that has made the M-16 and AR-15 instantly recognizable.

A user can stow the folding sight 100 of the present invention by pressing down on the knuckle 142. As the knuckle 142 is pressed down it slides along the track on the forward sight frame 108. As a consequence, the slide arm 140 is compressed into the slide arm base 138, thereby compressing the spring 139 contained therein. Once the recess on the knuckle 142 contacts the head of the set screw 146, the forward sight frame 108 pivots downwardly towards the rear portion 106 of the base 102 until the forward sight frame 108 lies substantially flush against the slide arm assembly 112 and the slide arm assembly 112 lies substantially flush against the center member 128 of the base 102, as shown in FIG. 8.

The folding front sight 100 may be deployed by pivoting the forward sight frame 108 forwardly, to its upright position. The spring 139 within the slide arm base 138 biases the slide arm 140 outwardly with sufficient force to provide a snap-action to the folding front sight 100.

In addition to the spring 139 contained in the slide arm assembly 112, spring-biased ball detents may be included in the forward sight frame 108. The spring biased ball detents are configured to selectively engage detents formed on the front portion 104 of the base 102. The spring-biased ball detents may be included to help keep the forward sight frame 108 from being unintentionally pivoted downwardly.

Figure 9:
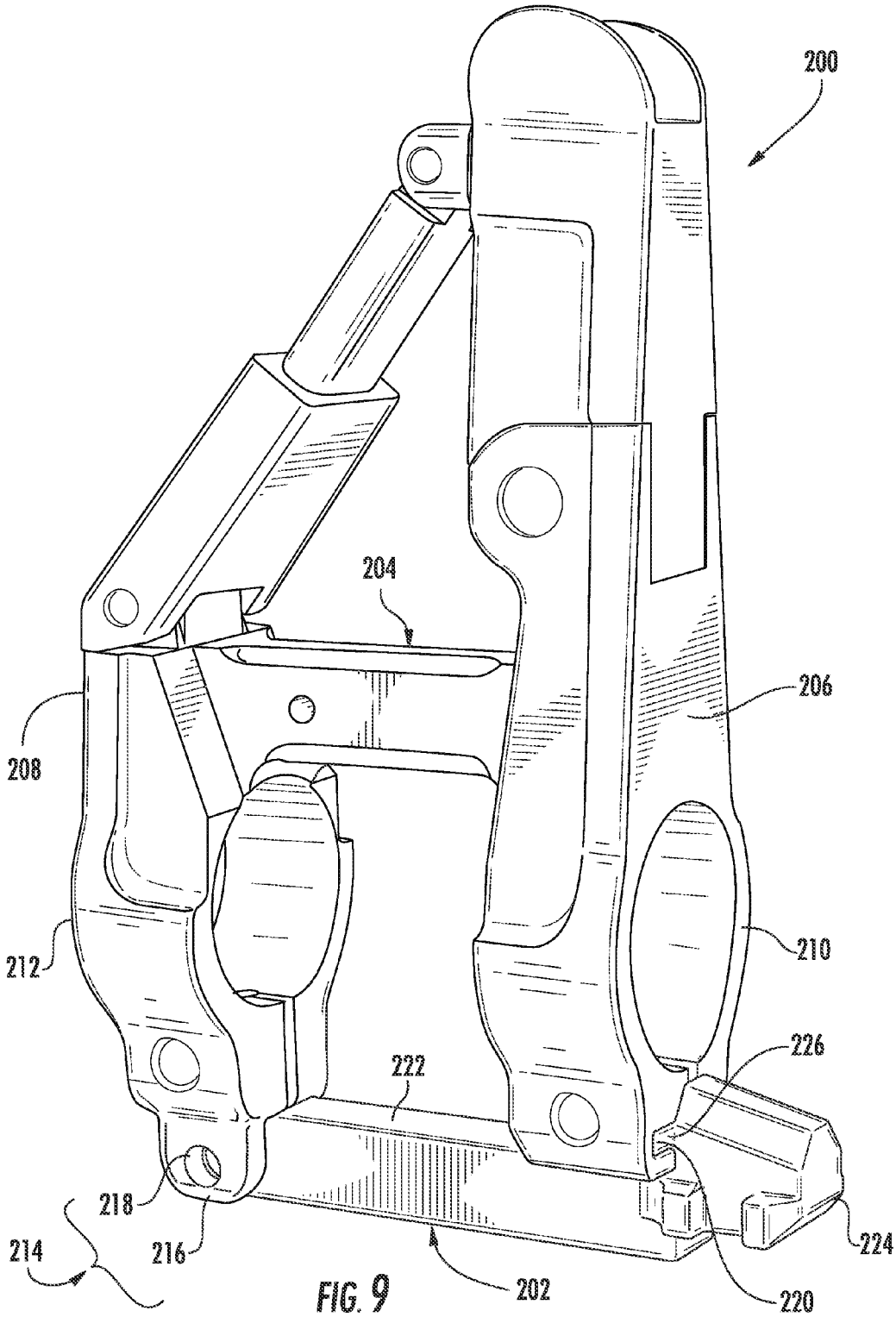
FIG. 9 is perspective view of an alternative embodiment of the folding front sight of the present invention that includes a removable bayonet lug.
Figure 10:
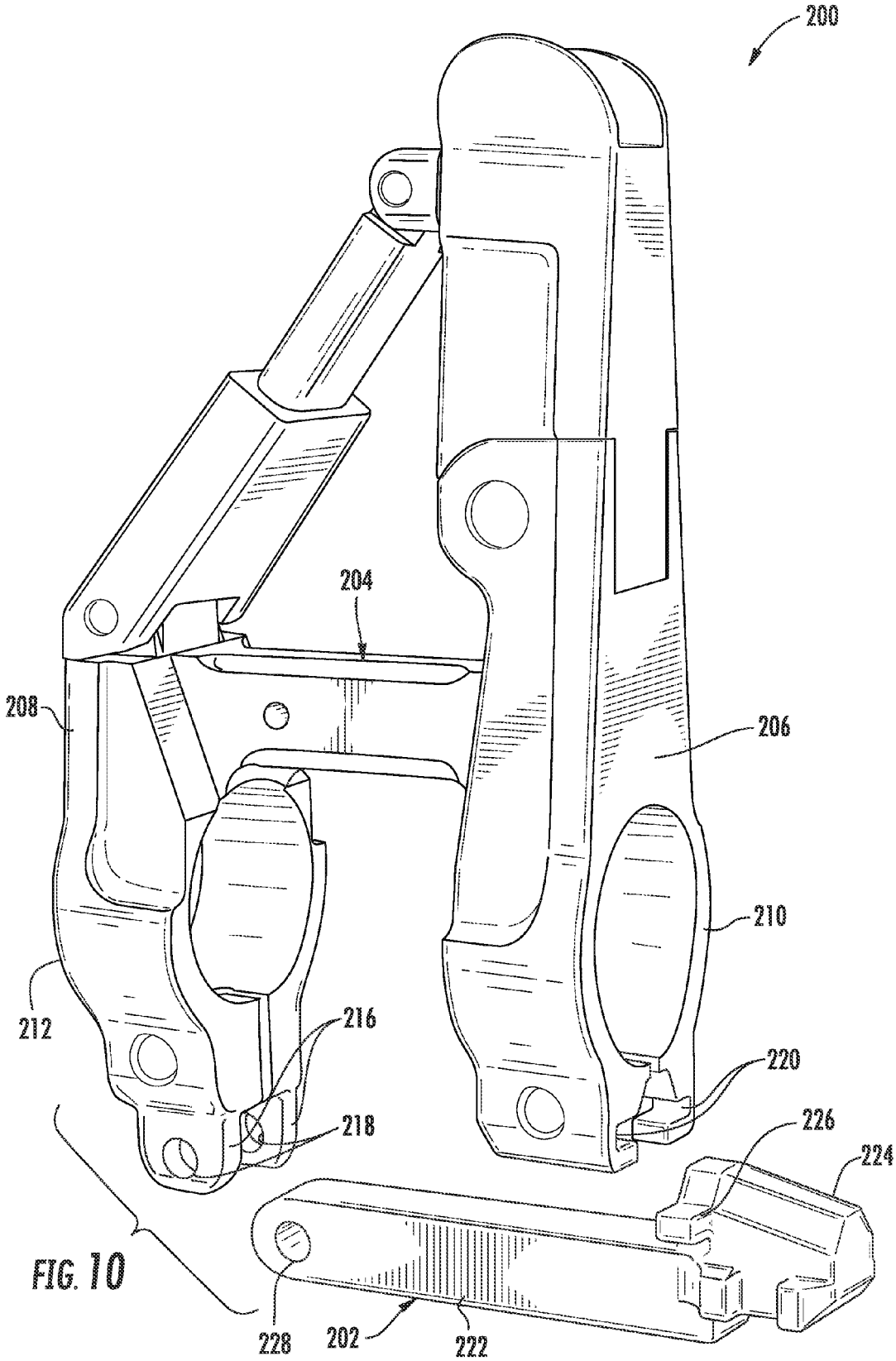
FIG. 10 is an exploded view of an alternative embodiment of the folding front sight of the present invention.
Figure 11:
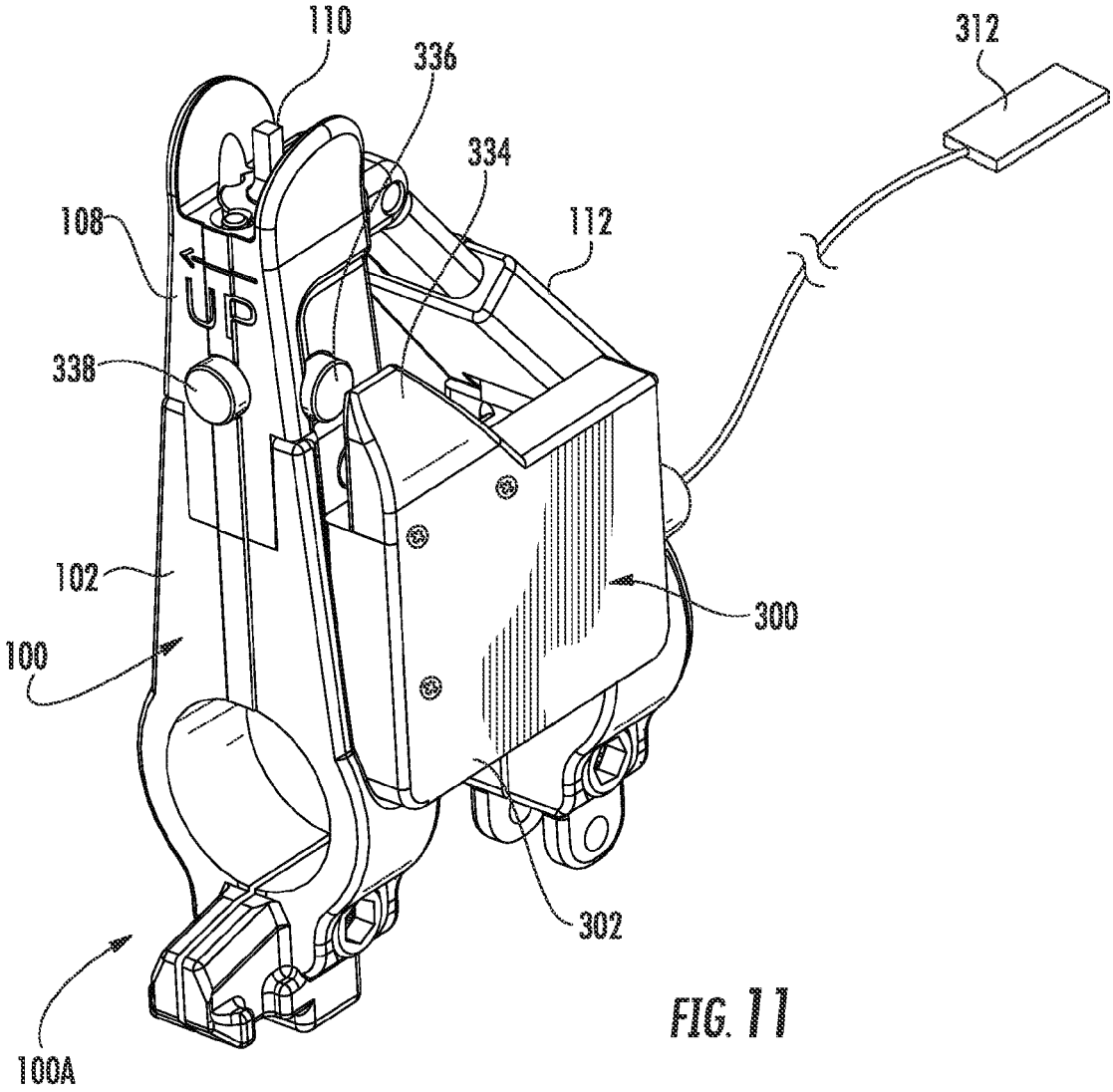
FIG. 11 is a perspective view of an alternate embodiment of the folding front sight including a laser aiming device in the forward sight frame.
Figure 12:
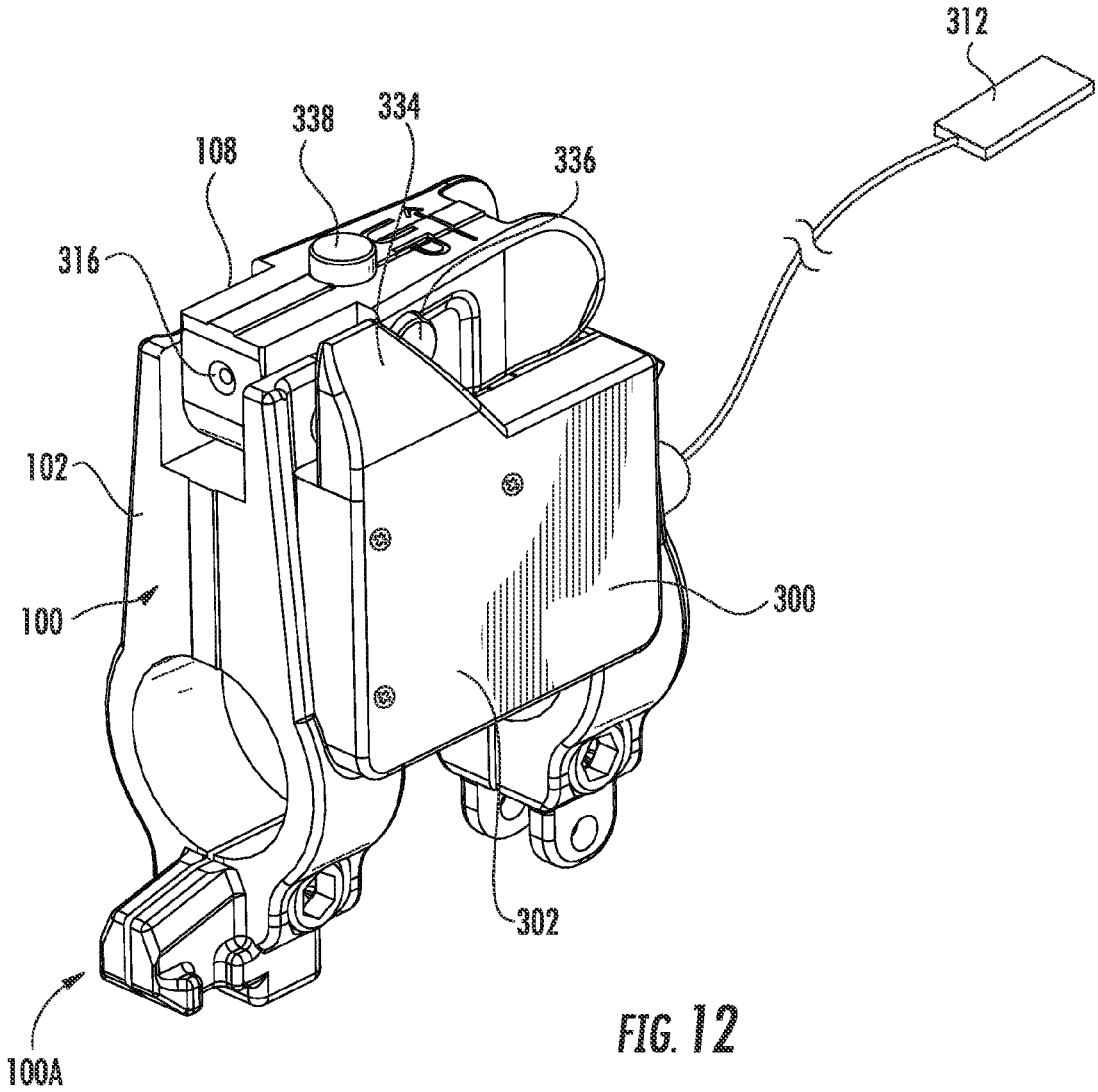
FIG. 12 is another perspective view thereof showing the forward sight frame in a stowed position and the laser aiming device in a now active position.
Figure 13:
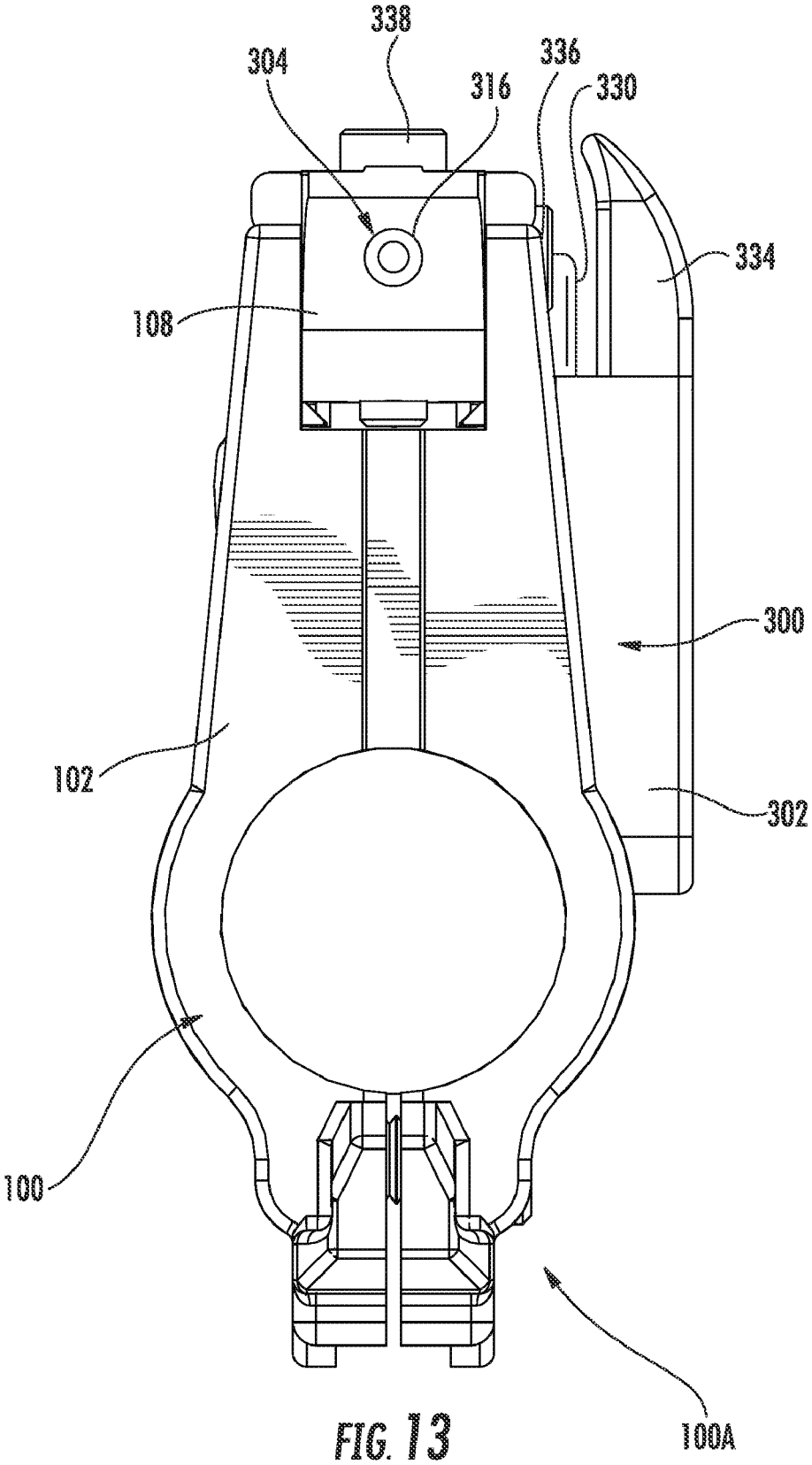
FIG. 13 is a front view thereof with the forward sight frame in the stowed position.
Figure 14:
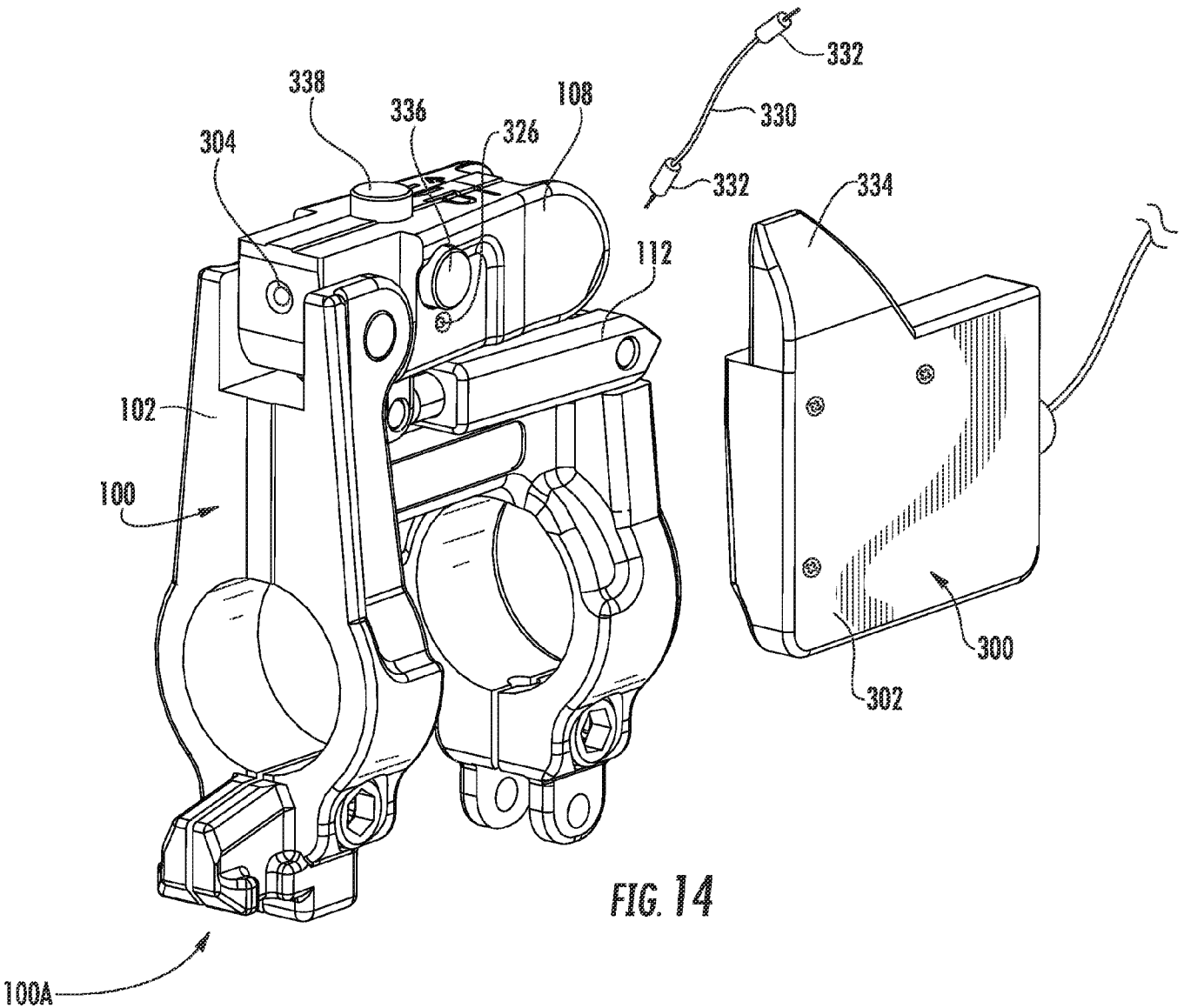
FIG. 14 is yet another perspective view with the laser aiming device housing portion separated from the base of the folding sight.
Figure 15:
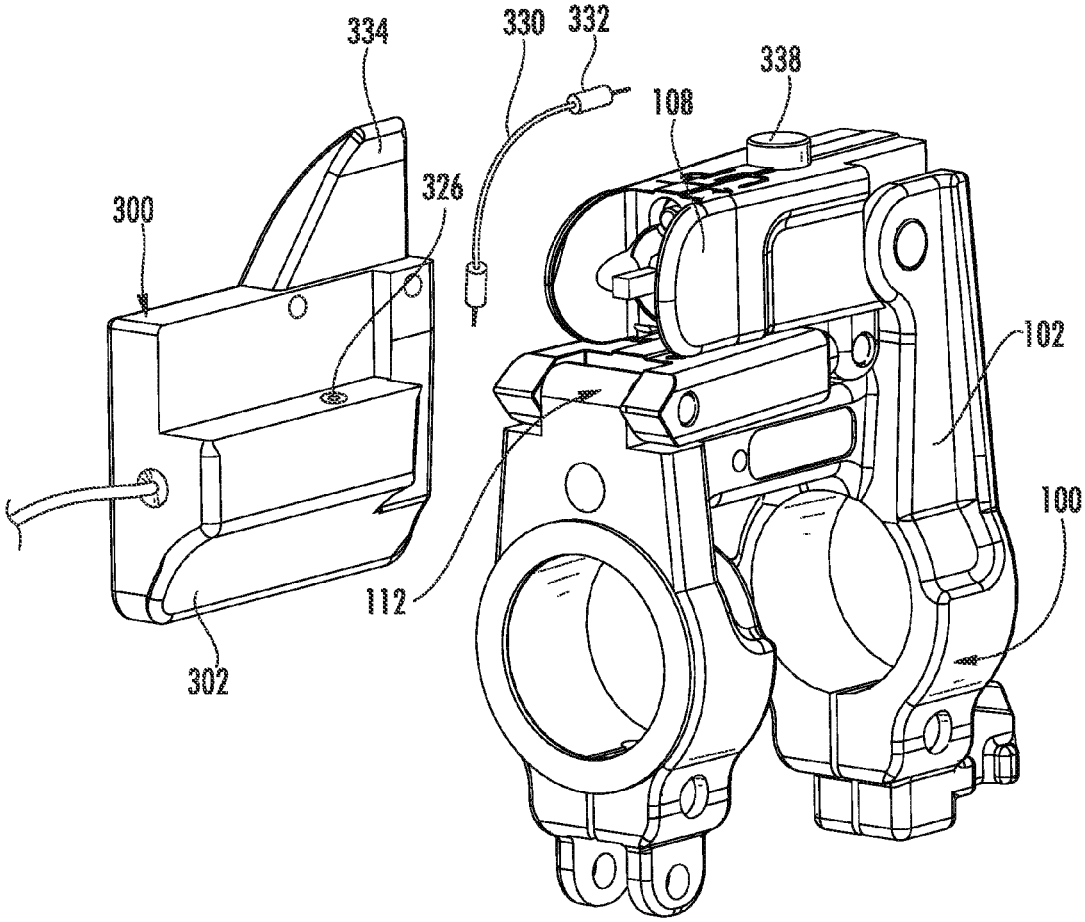
FIG. 15 is a rear perspective view of the same.
Figure 16:
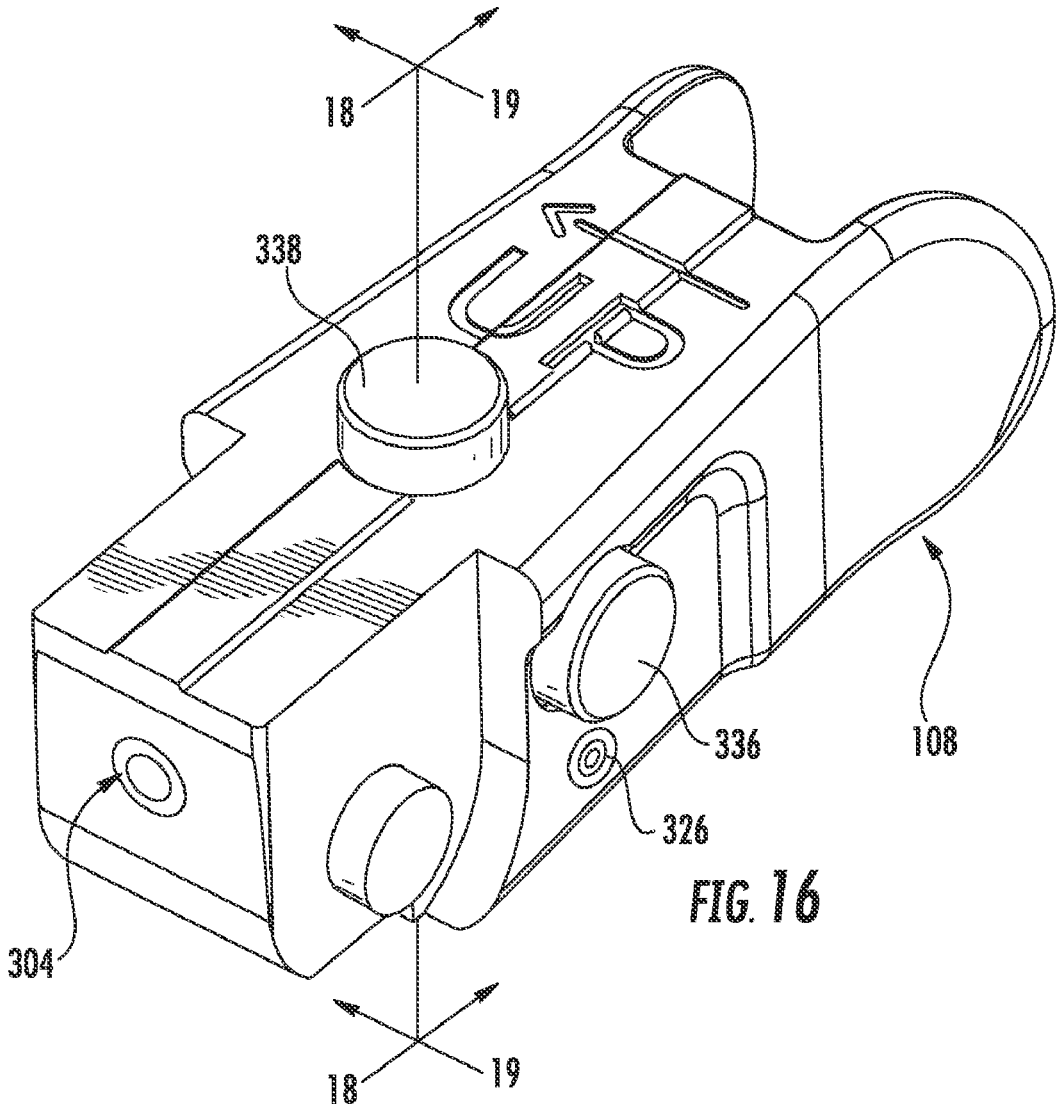
FIG. 16 is a perspective view of the forward sight frame.

Referring now to FIGS. 9 and 10, an alternative embodiment of the folding front sight of the present invention is shown generally at 200, which includes a removable bayonet mounting structure 202. Like, the preferred embodiment 100, the alternative embodiment 200 includes a base portion 204 with a front portion 206 and a rear portion 208. A pair of clamps 210, 212 depends from front and rear portions 206, 208 the base portion 204, respectively. The rearward most clamp 212 includes a sling swivel mounting structure 214, including a pair of opposing tabs 216 with through holes 218. The forward clamp 210, however, lacks an integral bayonet lug. Instead the forward clamp 210 includes a pair of opposing slots 220 configured to receive the bayonet mounting structure 202, which will be further described below.

The bayonet mounting structure 202 includes a center member 222 having a front end and a rear end. A bayonet lug 224 extends from the front end. The bayonet lug 224 is configured to receive and retain a bayonet, such as a standard USGI M7 Bayonet, to the barrel of the weapon. The bayonet lug 224 also includes a pair of laterally extending support tabs 226, which are configured to slide into slots 220 on the forward clamp 210.

The rear end of the center member 222 includes a through hole 228 configured to align with and be secured to the sling swivel mounting structure 214. It is important to note that the in this embodiment a sling swivel may not be mounted to the sling swivel mounting structure 214 at the same time as the bayonet mounting structure 202.

The alternative embodiment may include some or all the features described above for the preferred embodiment.

Turning now to FIGS. 11-20 there is an alternate version of the folding sight 100A including a laser aiming device generally indicated at 300 including a laser module 302 within the forward sight frame 108 of the folding sight 100 to provide enhanced target acquisition during night time or low-light operations.

The alternative folding front sight 100A includes a base 102, and a sight frame 108 having a front sight post 110 exactly as previously described in the original embodiment 100. The sight frame 108 is movable between an upright deployed position, and a stowed position as in the first embodiment 100 and includes the same slide arm assembly 112.

Additionally, a laser aiming device 300 is integrated with the folding front sight.

The laser aiming device includes a main body portion 302 affixed to the base 102 of the folding sight 100 and a laser diode module 304 mounted within the forward sight frame 108. The main body portion 302 includes a contoured outer surface, which is contoured to seat itself within the recesses of the outside surfaces of the base 102. Housed within the main body portion 302 is the self-contained power source 306, preferably coin cell batteries, and circuitry 308 to connect the power source 306 with the laser diode 310 and a switch 312 to selectively energize the laser diode 310.

Extending rearwardly from the main body portion 302 is a conventional tape switch assembly 312. However, it is to be understood that any configuration of switch 312 would be within the scope of the invention so long as it were capable of selectively energizing the laser diode. Hundreds of different switch configurations would be possible.

The laser diode module 304 is mounted within a longitudinal bore 314 in the sight frame 108. Generally, the laser diode module 304 includes a laser diode 310, a forward lens frame 316 and an articulating ball joint 318 that will allow windage and elevation adjustments of the laser diode 310 beam path 320. The lens frame 316 includes a crystal lens 316A or sight window to protect the internal components and seal them from the outside environment. The Lens frame 316 is threaded into the front end of the bore 314 to provide a sealed enclosure.

Figure 17:
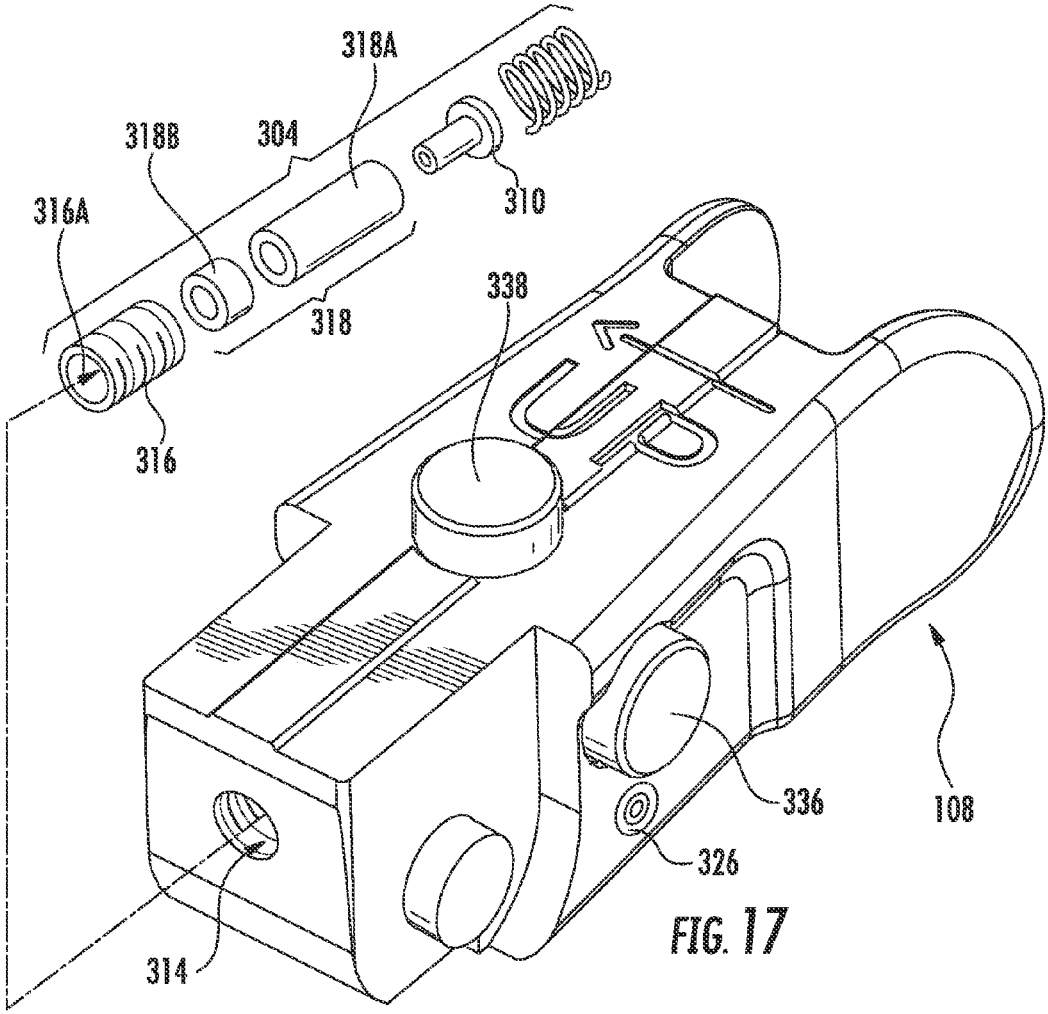
FIG. 17 is an exploded view thereof showing the internal components of the laser module.
Figure 19:
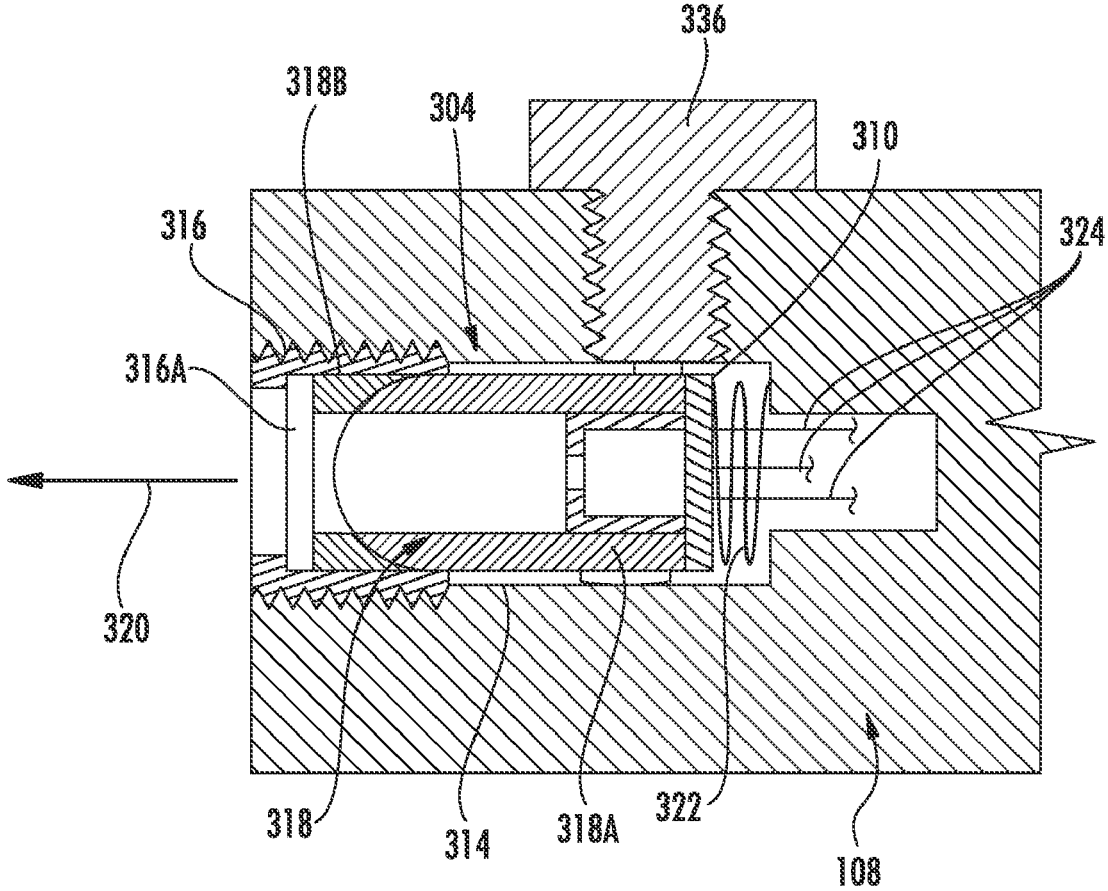
FIG. 19 is a cross-sectional view thereof taken along line 19-19 of FIG. 16.
Figure 20:
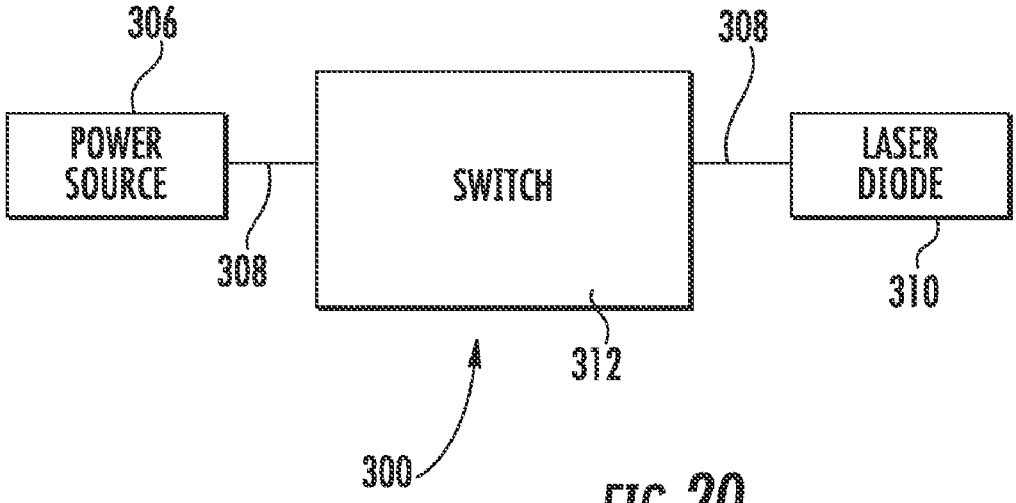
FIG. 20 is schematic block diagram of the laser module electronic components.

The laser diode 310 comprises a conventional laser diode device operable to emit a steady laser beam in the visible light spectrum. Typically, red or green spectrums are utilized for aiming devices. The laser diode 310 is housed within in a standard TO can package which is readily available from a variety of manufacturers, both domestic and foreign sources exist. Referring to FIGS. 17 and 19, the head of the TO can 310 is slidably received into the tail end of an elongated tube 318A having a spherical forward end. The forward end of the elongated tube 318A is received against a spherical concave surface on the back end of an insert 318B. The spherical surfaces of the tube 318A and insert 318B permit a 360 degree rotational movement of the laser diode 310 to adjust the beam path 320 of the laser diode 310. The forward end of the insert 318B is seated within a recess in the back surface of the lens frame 316. To maintain all of the components in a seated relationship, a spring 322 is provided at the rear end of the bore 314 which biases all of the components forward toward the lens frame 316 (See FIGS. 17 and 19).

Electrically, the terminals 324 of the laser diode 310 are connected with terminals of the power source in the main housing 302 by means of a connector and wire system extending from the sight frame 108 to the main housing 302. There is a connector socket 326 on the sight frame 108 and another connector socket 328 on the main body 302. A wire 330 with end connectors 332 plugs into the sockets 326 and 328 and provides power. The wire 330 is protected by a wing 334 extending from the main housing 302.

Generally, the laser diode module 304 is movable with the forward sight frame 108 such that when the forward sight frame 108 is in an upright deployed position, the laser aiming module 304 is in a stowed position (FIG. 11), and further such that when the forward sight frame 108 is in a stowed position (FIG. 12), the laser aiming module 304 is in a deployed position and operational to emit an aiming beam 320 parallel to the barrel 12 of the weapon 10.

Figure 18:
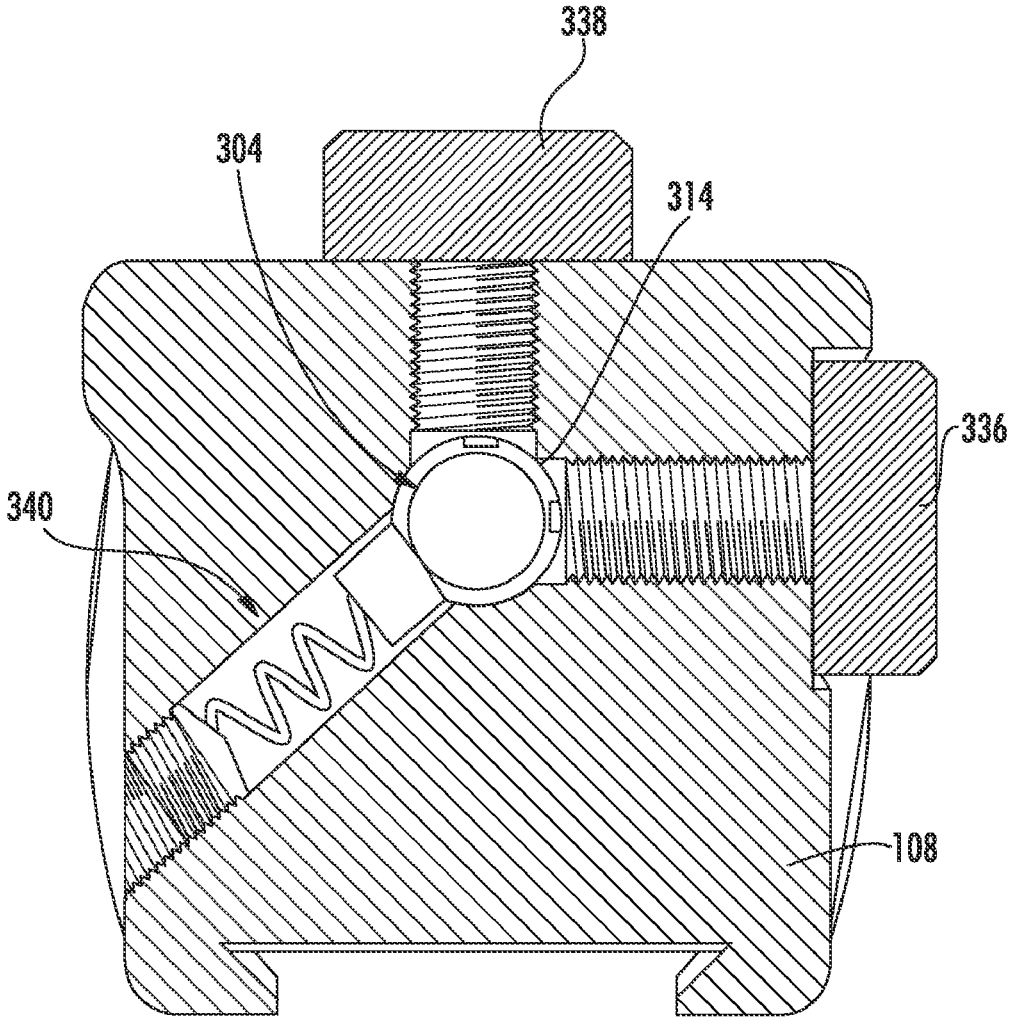
FIG. 18 is a cross-sectional view thereof taken along line 18-18 of FIG. 16.

Referring to FIGS. 18 and 19, the laser module 304 includes a windage screw 336 and elevation screw 338 which extend through the body of the sight frame 108 and engage with the outside surface of the tube 318A. A spring assembly 340 sits on a 120 degree angle from both to provide biasing back against the windage and elevation screws 336,338.

It should be understood that the laser module 304 can be used and implemented with other types of flip up sights and the inventive concepts herein should not be limited to the specific triangular folding sight as illustrated. There are dozens of folding front sights in which the present invention could be implemented. Likewise, the location, placement and configuration of the main housing 302, power sources 306 and switching devices 312 have limitless opportunities depending on the rail platforms and configuration of the underlying weapons. The main crux of the invention is the location of the laser module within the folding portion of the front sight so that when the sight is in the deployed position, the laser module is hidden and protected, and when the folding sight is stowed, the laser module is deployed for use upon activation of the switch.

Therefore, it can be seen that the present invention provides a unique solution to the problem of providing a folding front sight that mimics that appearance of a standard front sight.

It would be appreciated by those skilled in the art that various changes and modifications can be made to the illustrated embodiments without departing from the spirit of the present invention. All such modifications and changes are intended to be within the scope of the present invention.

I claim:

1. A folding front sight for a firearm, comprising:

a base;

a forward sight frame at a forward end of the base, said forward sight frame including a front sight post at an upper end thereof, and being movable between an upright deployed position, and a stowed position;

a laser aiming module mounted within said sight frame, said laser aiming module being movable with said forward sight frame such that when said forward sight frame is in an upright deployed position said laser aiming module is in a stowed position, and such that when said forward sight frame is in said stowed position, said laser aiming module is in a deployed position;

a power source for energizing said laser aiming module; and a switch coupled to said power source and said laser aiming module for selectively energizing said laser aiming module to output an aiming beam.

* * * * *